United States Patent [19]

Bavelloni

[11] Patent Number: 4,470,585

[45] Date of Patent: Sep. 11, 1984

[54] HOLDING DEVICE FOR GLASS PANES, MARBLE SLABS, AND LIKE BODIES

[75] Inventor: Franco Bavelloni, Appiano Gentile, Italy

[73] Assignee: Z. Bavelloni S.p.A., Bregnano Co, Italy

[21] Appl. No.: 365,749

[22] Filed: Apr. 5, 1982

[30] Foreign Application Priority Data

Apr. 14, 1981 [IT] Italy ..... 21143 A/81
Nov. 19, 1981 [IT] Italy ..... 23572/81[U]

[51] Int. Cl.[3] ..... B25B 11/00
[52] U.S. Cl. ..... 269/21; 269/22
[58] Field of Search ..... 269/21, 22; 248/362, 248/363, 205.5; 51/235; 294/69 R, 69 A, 69 B, 65; 279/3 R

[56] References Cited

U.S. PATENT DOCUMENTS 1,294,103 2/1919 Hitchcock ..... 269/21
3,116,919 1/1964 Alth ..... 269/21
3,156,462 11/1964 Weaver ..... 269/21
3,159,370 12/1964 Rubinstein ..... 248/362
3,180,604 4/1965 Hammer ..... 248/363

FOREIGN PATENT DOCUMENTS 835533 5/1960 United Kingdom ..... 248/362
977209 12/1964 United Kingdom ..... 269/21

*Primary Examiner*—Robert C. Watson
*Attorney, Agent, or Firm*—Guido Modiano; Albert Josif

[57] ABSTRACT

The holding device comprises a suction cup membrane of an elastically deformable material which can be contact engaged with a glass, marble or the like plate member to define, in cooperation with the plate, a chamber sealed against leakage from the outside, a piston assembly being provided for increasing the volume of the chamber in such a way as to increase the vacuum therein and the adhesion between the plate and the suction cup membrane.

5 Claims, 7 Drawing Figures

HOLDING DEVICE FOR GLASS PANES, MARBLE SLABS, AND LIKE BODIES

BACKGROUND OF THE INVENTION

This invention relates to a holding device for glass panes, marble slabs and like bodies.

As is known, many industrial processes performed on glass panes and the like workpieces, require that the sheets or plates being processed be firmly held such as to create a desired opposing force to the thrust of tools at work on the sheet or plate. Another problem is that of conveniently handling the various plates or sheets, which may be heavy and of large size, in order to move them to the various places of utilization.

To hold a glass pane securely, suction cup elements of substantially conical shape are currently employed which are brought to contact the sheet to be held. The desired holding action, by firm adhesion of the suction cups to the sheet, is achieved by the suction cups being communicated to a vacuum source which draws out amounts of air present inside the area included between the suction cup and glass sheet.

Of course, the adhesion force generated is the greater the deeper is the vacuum that can be generated.

With this type of a device, the disadvantage is encountered, first of all, that a vacuum feeding circuit must be made available which is highly expensive, and the useful area of the suction cups must be fairly limited or otherwise the need would arise for a very powerful suction, with consequent waste of power.

Therefore, with suction cups of conventional design it is necessary to provide for a high number of suction cups in order to achieve an adequate sheet or plate holding force.

SUMMARY OF THE INVENTION

It is a primary object of this invention to obviate such prior drawbacks by providing a holding device for plate-like elements of glass, marble, and the like, which can effectively engage the suction cup with the plate without recourse to any vacuum source, while advantageously achieving a considerably higher adhesion force than that which can be obtained through traditional techniques.

It is a further object of the invention to significantly simplify the system wherefor the suction cups are intended, in that it is possible to use larger size suction cups than traditional ones, without requiring the availability of a vacuum system.

Another object of the invention is to provide a device which, by virtue of its construction features, is highly reliable and safe in operation.

Yet another object of the invention is that of providing a device which can be readily formed from currently available materials, and is highly competitive from a purely economical standpoint.

These and other objects, such as will be apparent hereinafter, are achieved by a holding device for at least partially plate-like bodies of glass, marble and the like, characterized in that that it comprises a suction cup membrane formed from an elastically deformable material adapted in use to be contact engaged with a surface of said body to define, in cooperation with said surface, a chamber sealed against leakage from the outside, there being also provided means for increasing the volume of said chamber thereby increasing the vacuum formed therein and the adhesion force between said surface and said suction cup membrane.

BRIEF DESCRIPTION OF THE DRAWINGS

Further features and advantages will be apparent from the following description of two preferred, but not limitative, embodiments of the instant holding device for plate-like elements of glass, marble, and the like, with reference to the accompanying illustrative, and not limitative, drawings, where.

DESCRIPTION OF THE PREFERRED EMBODIMENTS

Figure 1:
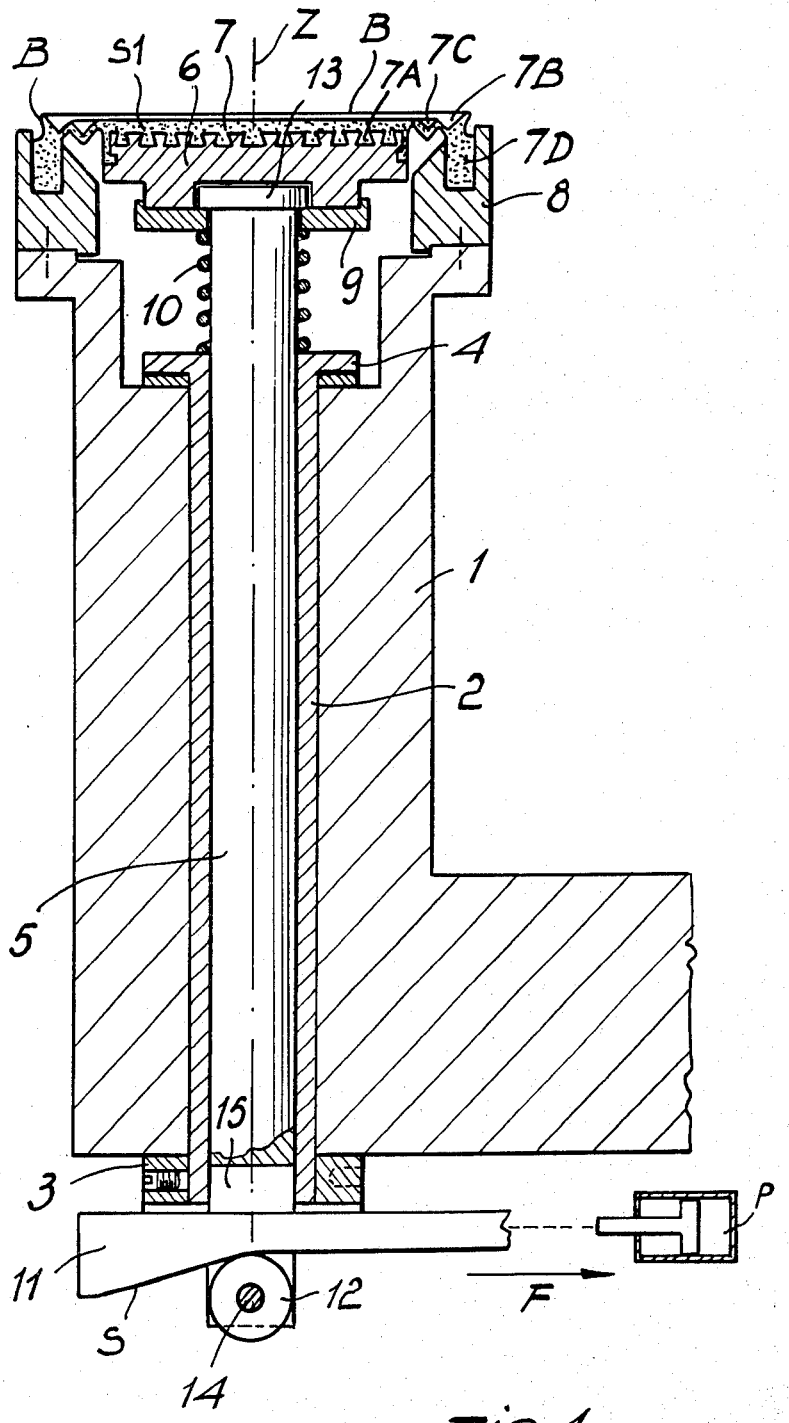
FIG. 1 is a sectional view of the device taken along an axial plane.

With reference to FIGS. 1 to 4, the device comprises a suction cup including a rubber body 7 made rigid with a metal support 6. The rubber body 7 has a circular profile contour, indicated at B, which is arranged coaxial with the axis Z shown in the drawing.

More in detail, the suction cup 7 has a central body, indicated at S1, which is attached to the support 6 and is connected to a peripheral lip 7B through the interposition of a bellows region 7C.

Rigid with the body 7 of the suction cup, there is further provided an annular attachment portion 7D which is accommodated in a seat defined together with an annular support 8 which is connected to a support 1 constituting the fixed structure.

The body 6 supporting the central portion of the suction cup is secured to a vertical shaft 5 such that it cannot perform axial movements with respect to the shaft, but can rotate, if necessary, relatively to the shaft about the axis Z. In particular, in the example shown in the figures, the shaft 5 comprises, at the top, a widened head 13 accommodated in a seat between the body 6 of the suction cup and a flange 9 fastened to the body 6 by means of screws.

The reference numeral 2 designates a bushing which is secured to the fixed support 1 through its head 4 and a ring 3 secured to the bottom of the bushing. The reference numeral 10 designates a return spring located between the flange 9 and the head 4. At 11 is indicated a member adapted to act, through a sloping surface S of cam-like configuration, on a roller 12 pivoted to the shaft 5 by means of a pivot pin 14. More specifically, the roller 12 is located in a cut 15 formed in the shaft 5 and is secured to said shaft by means of the pin 14.

Said cam 11 is connected to a piston P of an air-operated cylinder adapted to pull the cam in the direction of the arrow F.

The device operates as follows. Initially, that is in the inoperative condition, the device presents itself in its rest position as shown in FIG. 1. When a body having at least one smooth flat surface, such as a glass pane, is laid with said smooth face onto the suction cup, that is onto the body 7, and more specifically onto the peripheral edge B which, in the inoperative condition, is located at a higher level than the rest of the body 7, the edge B yields and said smooth face of the glass pane practically moves to contact the rubber flat surface S1. Then the operator actuates the pneumatic cylinder P to produce a displacement of the cam 11 in the direction of the arrow F, whereby the shaft 5 completes a downward movement against the action of spring 10, to entrain the suction cup, that is the assembly comprising the metal body 6 and rubber body membrane 7. Consequently, a chamber 16 forms between the rubber membrane 7 and surface of the glass pane 17, thus creating a negative pressure. The shaft 5 stops at a certain point hereinafter called operative vacuum balanced position, because a balanced force situation occurs, between the vacuum action, the spring 10 action and the pneumatic piston action this taking place after only one portion of the surface S has pressed against the roller 12 (i.e. a leading portion of the surface S has pressed against the roller 12).

Figure 2:
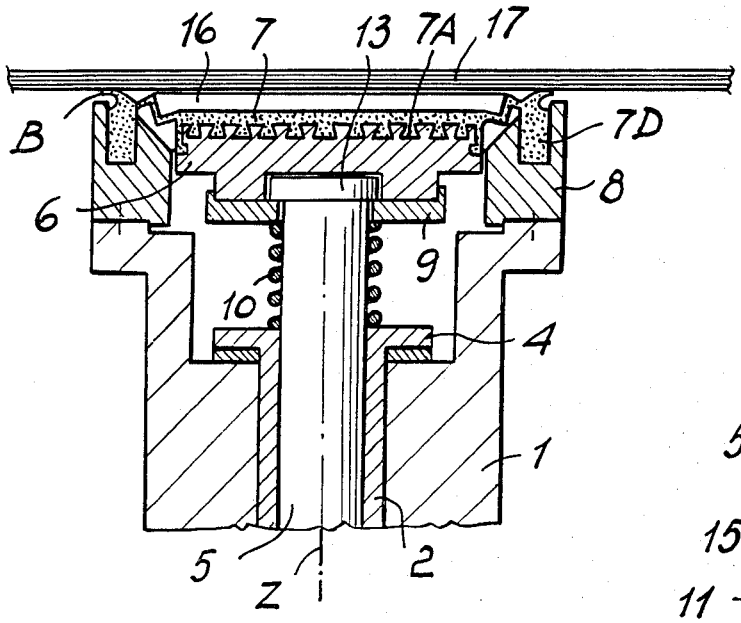
FIG. 2 is a detail view of a modified configuration of the device.
Figure 4:
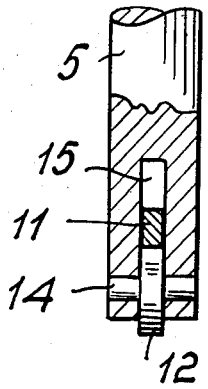
FIG. 4 is a further detail view.
Figure 3:
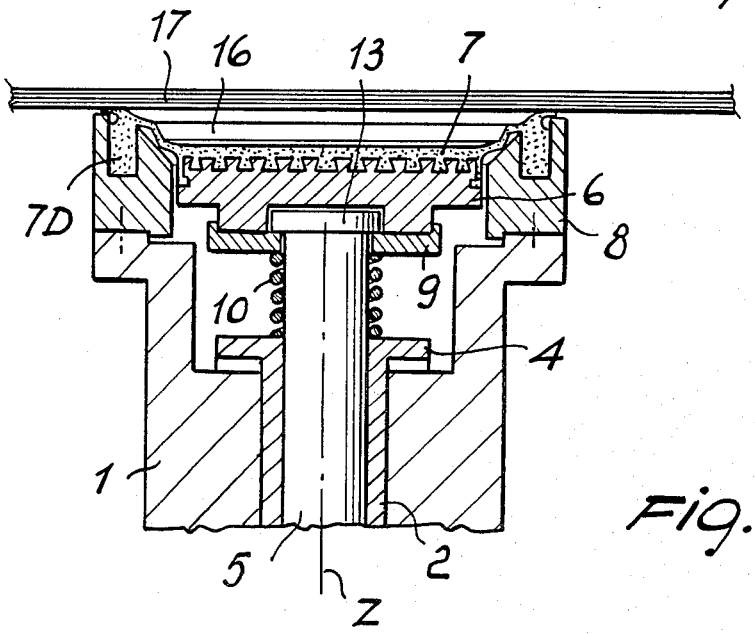
FIG. 3 is a similar detail view of another device configuration.

The spring 10 still has a certain amount of compressive force. The glass pane 17, therefore, is held firmly attached to the suction cup, and the suction cup presents itself, for example, as shown in FIG. 2. Then, as time goes by, should there occur air leakages into the chamber 16 formed between the rubber 7 and glass pane 17, automatically the cam 11 moves under the action of pneumatic piston P to further lower the shaft 5 and, accordingly, increase the volume of the chamber 16 between the body 7 and glass pane surface. Thus, the negative pressure within said chamber is increased and, at a certain point, the system stops automatically in a fresh operative vacuum balanced position of equilibrium. The phenomenon is reiterated until the whole sloping surface S has been past the roller 12 in contact therewith. It should be noted that, while the shaft 5 moves axially, and along with it the metal body 6 and rubber membrane 7 attached thereto, the annular portion 7D of the rubber membrane remains instead stationary, because it is attached to the annular element 8, in turn attached to the support 1. The rubber membrane can undergo deformation to follow the (downward) movements of the shaft 5, by virtue of its bellows portion comprising the annular grooves 7B and 7C. It will be understood that the device as above describes an automatic compensation of the vacuum losses occurring owing to leakages in the suction cup is obtained.

Figure 5:
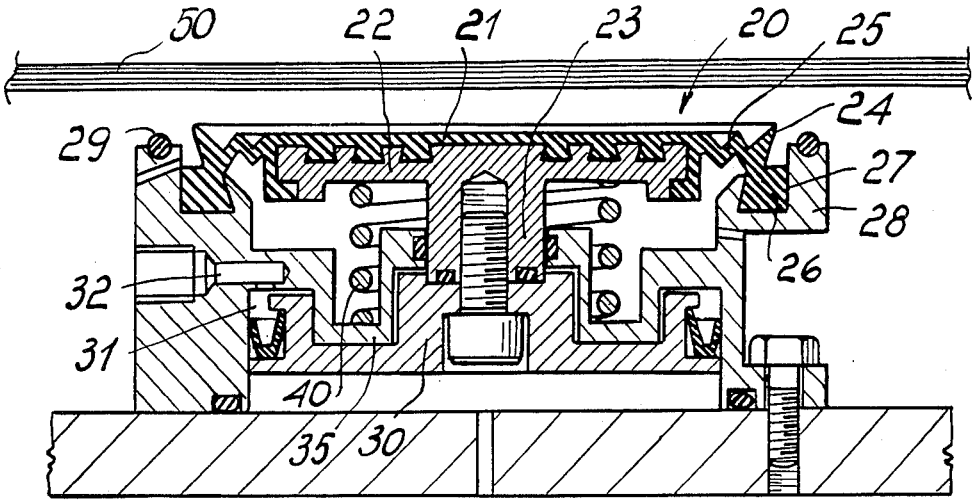
FIG. 5 is a cross-sectional view of a different embodiment.

According to another embodiment (FIGS. 5, 6 and 7) of the invention, which connects in principle to the one just described, the device comprises a suction cup membrane, generally indicated at 20, the midportion 21 whereof is supported on a plate 22 rigidly secured to an axial shank 23.

The suction cup membrane 20, which is advantageously of circular configuration, has a peripherally extending lip 24 which is connected to the midportion 21 by corrugated extensible portions 25. The suction cup membrane 20 is provided, peripherally thereto, with an annular locking body 26 which is inserted into a corresponding seat 27 defined on an annulare flange 28 which is a part of the fixed structure. At the top of said flange 28, an annular gasket 29 is arranged which serves to prevent the sheet or plate surface from becoming damaged during the contacting process step.

A peculiar feature of the invention resides in that the shank 23 is connected to a piston 30 movable in sealed relationship inside a cylindrical chamber 31 which is communicated at the top to a pressurized fluid delivery line 32.

The cylinder formed by the piston 30 and cylindrical chamber 31 may be either air- or oil-operated, depending on contingent requirements. Between the bottom face of the plate 22 and top head 35 of the cylindrical chamber 31, a spring 40 is arranged to act which has the function of returning the piston 30 upon termination of the pressurized fluid action.

Figure 6:
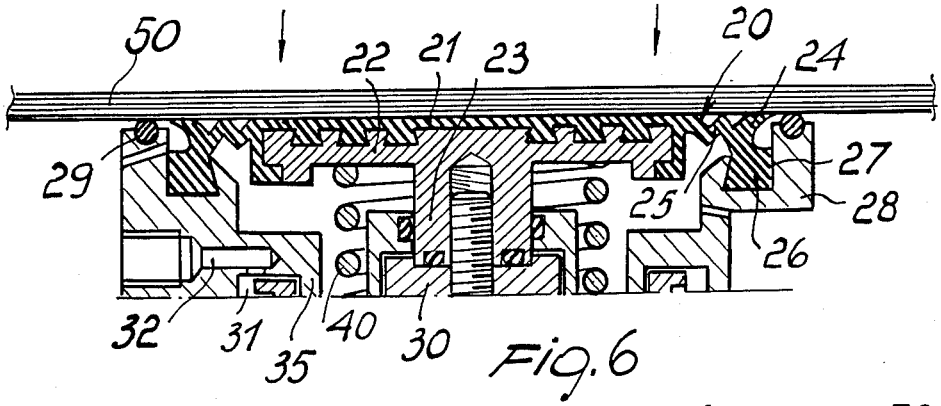
FIGS. 6 and 7 illustrate the embodiment of FIG. 5, in two different positions of operation.
Figure 7:
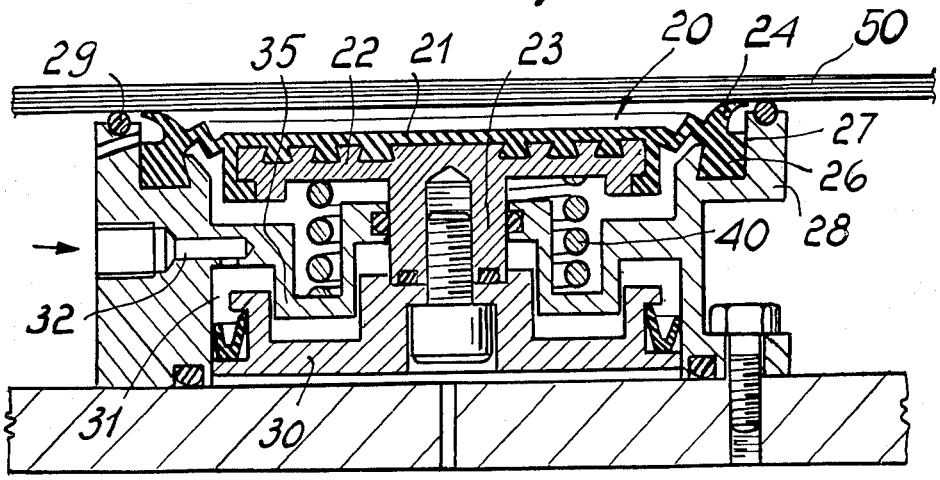

The operation is similar to that described previously hereinabove. In fact, the glass sheet, schematically indicated at 50, is laid onto the suction cup membrane 20 which will be initially at its raised position (FIG. 5), and under the sheet own weight, deforms the membrane as shown in FIG. 6.

In this condition, the suction cup membrane 20 will practically form, in cooperation with the glass pane itself, a chamber which is sealed tight from the outside environment.

In order to apply the desired adhesion action, the piston 30 is operated to move downwards, through the admission of pressurized fluid into the cylindrical chamber 31.

The pressure applied to the piston 20 causes the shank 23 to move downwards to result in an increased volume of the chamber defined by the suction cup membrane 20 and glass pane, which practically corresponds to the formation of a negative pressure or vacuum inside the chamber, which creates the desired adhesion of the suction cup membrane to the sheet.

Of course, the greater is the deformation which occurs, the deeper will be the vacuum formed within the chamber, which vacuum is a direct function of the action applied through the piston 30.

It should be further added that, in the event of leakage from the outside toward the chamber inside between the membrane and plate-like workpiece, the negative pressure would be automatically maintained by the piston 30 moving further down.

Among the advantages afforded by the device of this invention, worth mentioning are its great simplicity, especially over suction cups utilizing pumps, while affording highly satisfactory results from its various applications. In particular, on machines for working or processing glass, marble, wood, plastics, or other materials, as well as for other applications, such as for object lifting in general.

Obviously, the device of this invention is considerably more advantageous than conventional suction cups of the type which are pressed against a smooth surface to push the air out. Naturally, it will be appreciated that, in addition to the embodiments described hereinabove, many variations are also possible without departing from the scope of the invention.

I claim:

1. A suction cup holding device for at least partially plate like bodies of glass, marble and the like, comprising a supporting body having an annular formation at one end thereof, said annular formation defining a space surrounded by said annular formation, a suction cup membrane arranged at least partially within said space, said suction cup membrane having a peripheral edge portion fixed on said annular formation, a central portion and an intermediate portion between said central portion and said peripheral edge, at least said intermediate portion of said membrane being expandable and made of elastically deformable material thereby to allow said central portion to move from a rest position thereof into operative vacuum balancing positions at a distance from said rest position, a support member for said central portion connected thereto, first actuation means for said support member for moving in use said central portion of said suction cup membrane against vacuum action acting thereon from said rest position into said operative vacuum balancing positions thereof and second actuation means acting in a direction opposite to said first actuation means for moving said central portion from said operative vacuum balancing positions into said rest position thereof and wherein said first actuation means include pneumatic piston means acting in use with a selected balancing force generated by said pneumatic piston means against the action of said second actuation means and against said vacuum action to bring said central portion in successive vacuum balanced operative positions thereof thereby automatically to compensate the losses of said vacuum action due to vacuum leakages whenever occurring through said suction cup membrane.

2. A device according to claim 1, wherein said intermediate portion of said membrane has a bellows like structure.

3. A device according to claim 1, wherein said peripheral edge has an enlarged formation fixed on said annular formation and a lip formation opposite to said enlarged formation and projecting therefrom to a level offset with respect to said intermediate and said central portion of said membrane.

4. A device according to claim 1, wherein said support member for the central portion of said membrane comprises a shaft with a widened head fixed to said central portion of the membrane and wherein said first actuation means include a sloping surface cam member connected with said pneumatic piston means and a cam follower on said shaft and in engagement with said sloping surface, to axially move said shaft by said cam member when said pneumatic piston moves said cam member.

5. A device according to claim 1, wherein said supporting body defines a cylinder chamber below said suction cup membrane and wherein said pneumatic piston means include a piston slidable within said cylinder chamber and rigidly connected to said support member for the central portion of said membrane and duct means for selectively feeding fluid under pressure to said cylinder chamber for actuating said piston.

* * * * *